US007089807B2

(12) United States Patent
Hsieh

(10) Patent No.: US 7,089,807 B2
(45) **Date of Patent: *Aug. 15, 2006**

(54) LOW-COST HIGH PRECISION TWISTING MEASURING DEVICE

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/036,699

(22) Filed: Jan. 18, 2005

(65) Prior Publication Data

US 2006/0156833 A1 Jul. 20, 2006

(51) Int. Cl.
*B25B 23/14* (2006.01)

(52) U.S. Cl. ..... 73/862.22

(58) Field of Classification Search ..... 73/862, 73/862.21, 862.08, 862.181, 862.22, 862.23, 73/862.338, 862.331
See application file for complete search history.

(56) References Cited

U.S. PATENT DOCUMENTS

| | | | | |
|---|---|---|---|---|
| 4,257,263 | A * | 3/1981 | Herrgen | 73/862.23 |
| 5,345,636 | A * | 9/1994 | Lamons | 7/139 |
| 5,476,014 | A * | 12/1995 | Lampe et al. | 73/862.23 |
| 5,589,644 | A * | 12/1996 | Becker et al. | 73/862.23 |
| 5,769,781 | A * | 6/1998 | Chappuis | 600/202 |
| 6,463,811 | B1 * | 10/2002 | Putney | 73/862.21 |
| 6,569,108 | B1 * | 5/2003 | Sarvazyan et al. | 600/587 |
| 6,784,799 | B1 * | 8/2004 | Hsien | 73/862.21 |

* cited by examiner

*Primary Examiner*—Max Noori

(57) ABSTRACT

A low-cost high precision twisting measuring device comprising a tool body; the tool body comprises a handle having a display; at least one end of the handle having a driving portion; each connection between the handle and each driving portion having a piezoelectric ceramic sensor; the piezoelectric ceramic sensor being connected to the display through a conductor; the piezoelectric ceramic sensor serving to convert mechanical power due to operation of the spanner into electric power with a form of voltage signals; the voltage signal being transferred to the display through the conductor.

3 Claims, 6 Drawing Sheets

LOW-COST HIGH PRECISION TWISTING MEASURING DEVICE

FIELD OF THE INVENTION

The present invention relates to hand tools, and in particular to a piezoelectric ceramic sensor is not confined by the size and thus the recess in the tool body for receiving the piezoelectric ceramic sensor can be smaller than those used for the prior art strain gauge. The piezoelectric ceramic sensor acts without needing power supply for converting dynamic power into electric power.

BACKGROUND OF THE INVENTION

Currently, there are many hand tools need to know the twisting force of the tool applied to an object so that the user can well control the operation of the tool. Thereby there are many tools which are equipped with the twisting force measuring tool. In one prior art, a measuring rod interconnected to the driving head so that when the driving head is driven, the measuring rod will displace so that the twisting force can be got from the displacement of the measuring rod.

In another prior art, springs and rolling shafts are embedded into the handle of an open ended spanner so as to achieve the object of measuring the twisting force.

In above two prior arts, the structure is complicated and thus the cost is high and the assembly work is laborious. Thereby it is necessary to be improved.

Thereby electronic twisting force measurement devices are developed. One is the electronic twisting force measuring spanner, wherein a bridge circuit strain gauge is developed for sensing the deformation of the spanner. The strain gauge has a preferred effect to sense the twisting force, but the strain gauge is expensive so that this kind of prior art can be not widely accepted.

SUMMARY OF THE INVENTION

Accordingly, the primary object of the present invention is to provide a low-cost high precision twisting measuring device, wherein cost is low, the structure is simple and the precision is high. Thereby the manufacturing process can be performed rapidly. It is preferred than the prior art bridge circuit strain gauge.

Furthermore, the piezoelectric ceramic sensor is not confined by the size and thus the recess in the tool body for receiving the piezoelectric ceramic sensor can be smaller than those used for the prior art strain gauge.

Moreover it is unnecessary to have any power supply. The piezoelectric ceramic sensor acts without needing power supply for converting dynamic power into electric power.

To achieve above objects, the present invention provides a low-cost high precision twisting measuring device which comprises a tool body; the tool body comprises a handle having a display; at least one end of the handle having a driving portion; each connection between the handle and each driving portion having a piezoelectric ceramic sensor; the piezoelectric ceramic sensor being connected to the display through a conductor; the piezoelectric ceramic sensor serving to convert mechanical power due to operation of the spanner into electric power with a form of voltage signals; the voltage signal being transferred to the display through the conductor.

The various objects and advantages of the present invention will be mere readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
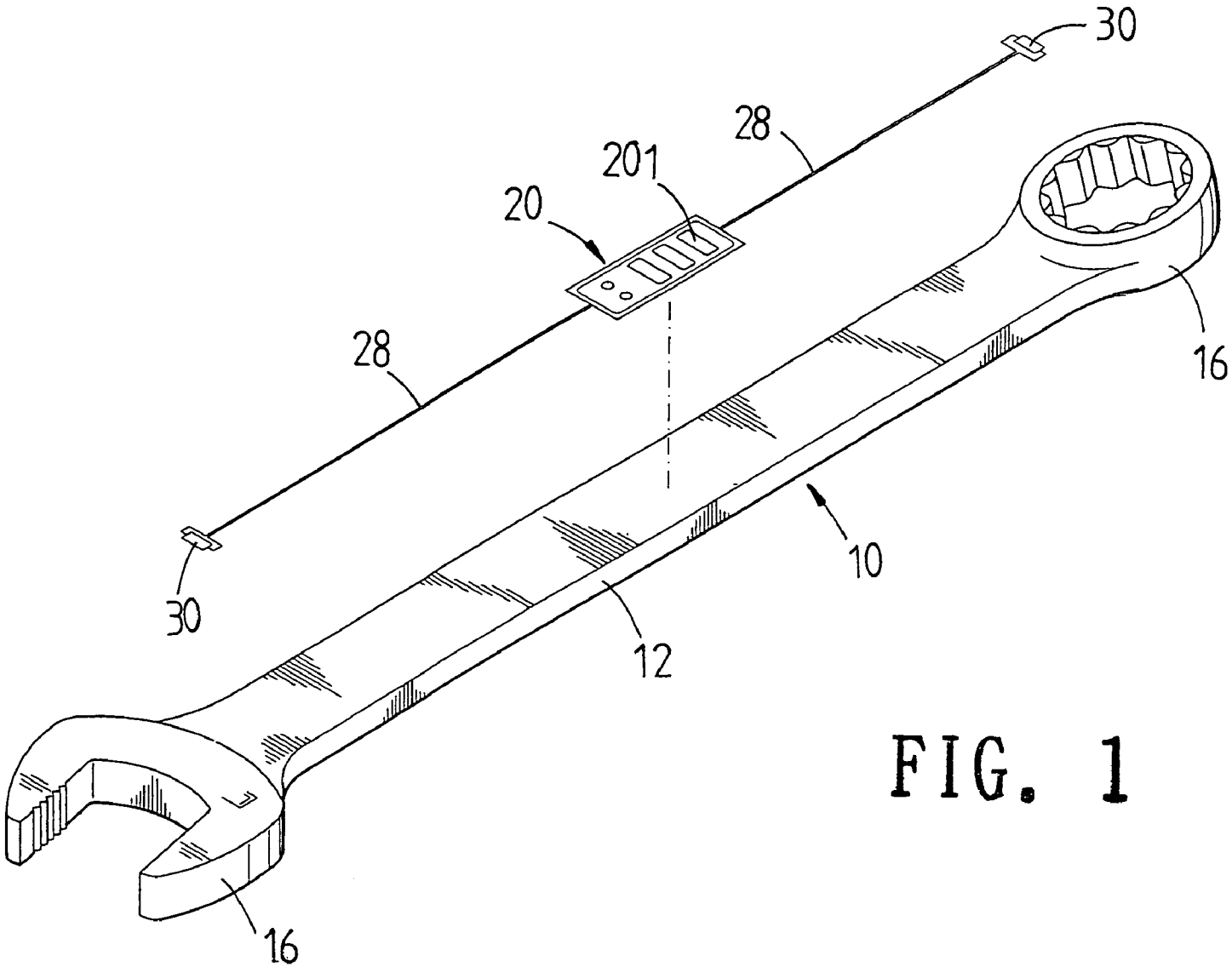
FIG. 1 is an exploded schematic view of the low-cost high precision twisting measuring device of the present invention.
Figure 2:
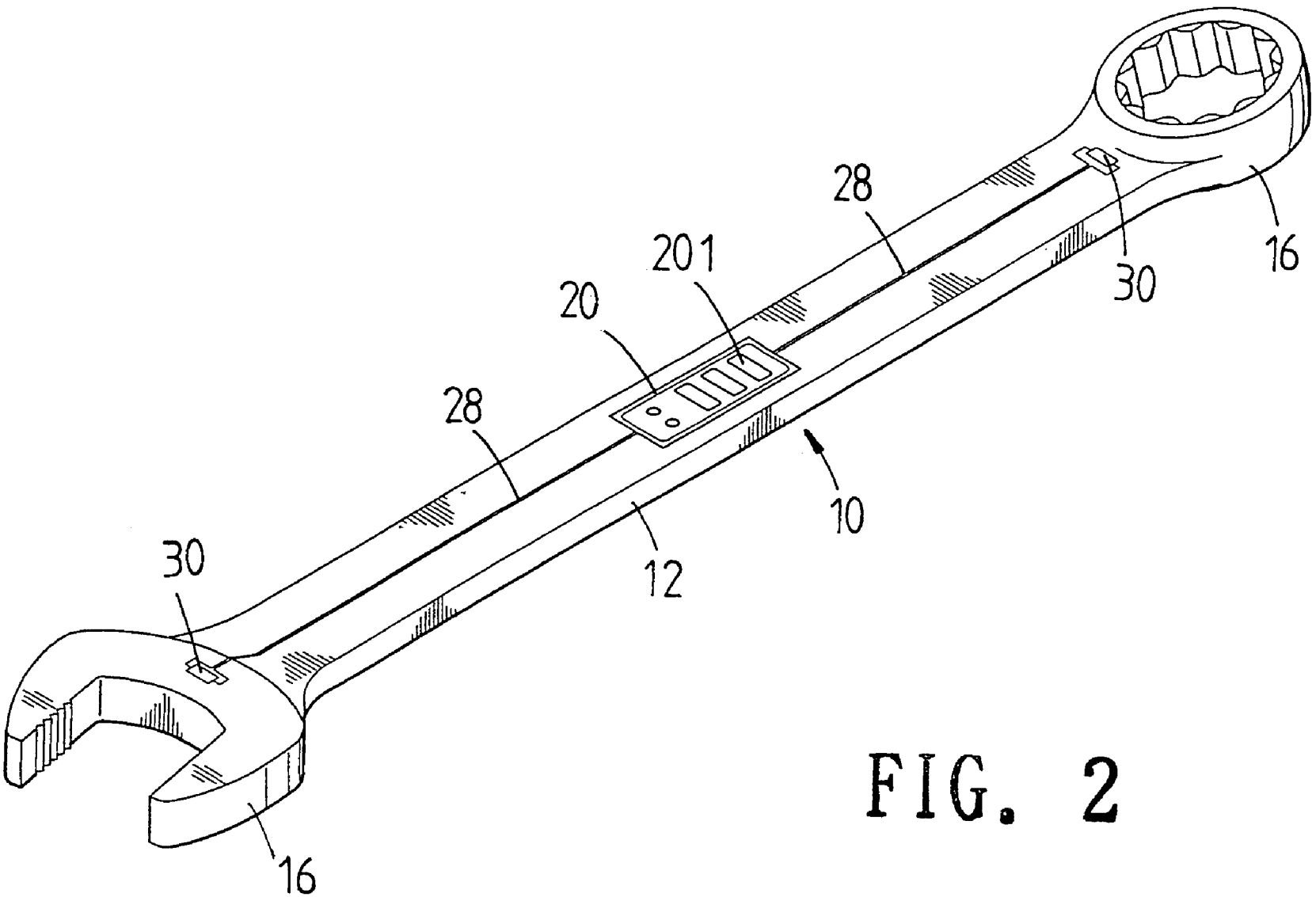
FIG. 2 is a schematic perspective view of the low-cost high precision twisting measuring device of the present invention.
Figure 3:
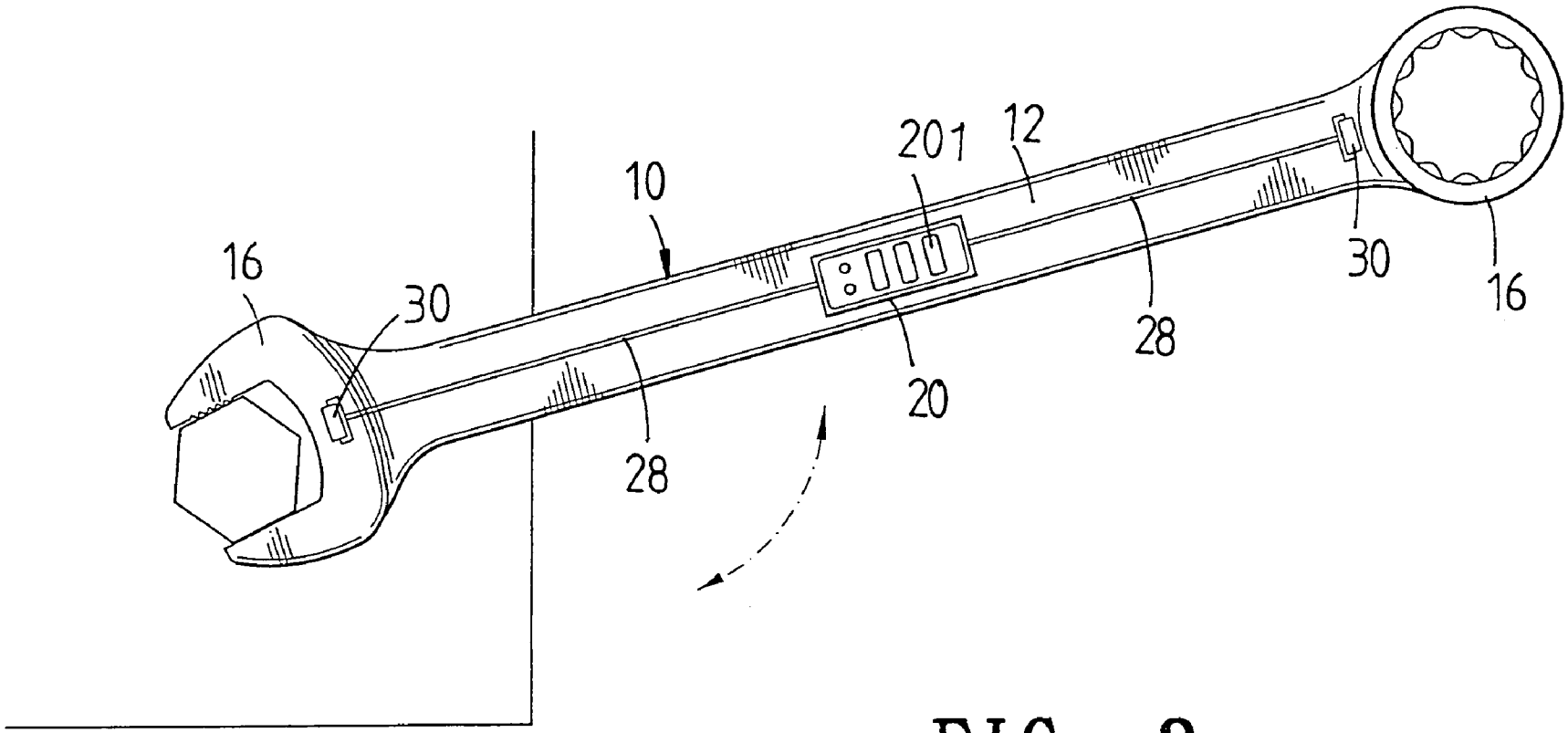
FIG. 3 is a schematic view showing the application of the low-cost high precision twisting measuring device of the present invention.

Referring to FIGS. 1 to 3, the low-cost high precision twisting measuring device of the present invention is illustrated. In this embodiment, a ring spanner is used as an example for describing the present invention, while the present invention is not confined by the ring spanner. The present invention has a tool body 10. The tool body 10 has the following elements.

A handle 12 has a display 20. The display 20 has a screen, a converter, and a power supply. The display 20 is frequently used in electronic twisting spanners. Thereby the details will not be described here.

Two ends of the handle 12 have two driving portions 16, respectively. One driving portion 16 is an open ended driving portion 16 and another driving portion 16 is a ring driving portion 16.

Each connection between the handle 12 and each driving portion 16 has a piezoelectric ceramic sensor 30. The piezoelectric ceramic sensor 30 serves to convert mechanical power from the operation of the spanner into electric power (voltage signal) as a form of voltage signal. The voltage signal is transferred to the display 20 through conductors 28 on the surface of the handle 12 so as to display the twisting force.

The improvement of the present invention is that no strain gauge is used. The piezoelectric ceramic sensor 30 is used to replace strain gauge. The piezoelectric ceramic sensor 30 is cheap, easy to be manufactured, not confined due to appearance or size, heat-tolerant, and chemical stability, etc. It is preference that the strain gauge by a bridge circuit.

To be appreciated, the piezoelectric ceramic sensor 30 can inter-convert the dynamic power and electric power. The piezoelectric ceramic sensor is polarized due to dynamic pressure from any direction so that two ends of the piezoelectric ceramic sensor generate positive and negative charges, namely piezoelectric effect. Furthermore, the dynamic power is converted into electric power (i.e., voltage). Then two electrodes of the piezoelectric ceramic sensor 30 are connected to the conductors 28 so as to transfer piezoelectric signals to the display 20. A converter (not shown) in the display 20 will convert voltage signals into digital signals to be displaced on a screen 201 of the display 20 so as to display precise twisting force of the spanner.

Moreover, the display, piezoelectric ceramic sensor and conductor are adhered to the tool body.

Besides, the piezoelectric ceramic sensor 30 is better than the current used bridge circuit strain gauge. This is preferred for the current hand tools which are manufactured by forging. Thereby it can measure the twisting force precisely even the variation is very small. Thereby the piezoelectric ceramic sensor is preferred at cost of material, resolving the problem of over-machining, sensitivity, and precision, which is better than known prior art.

Figure 4:
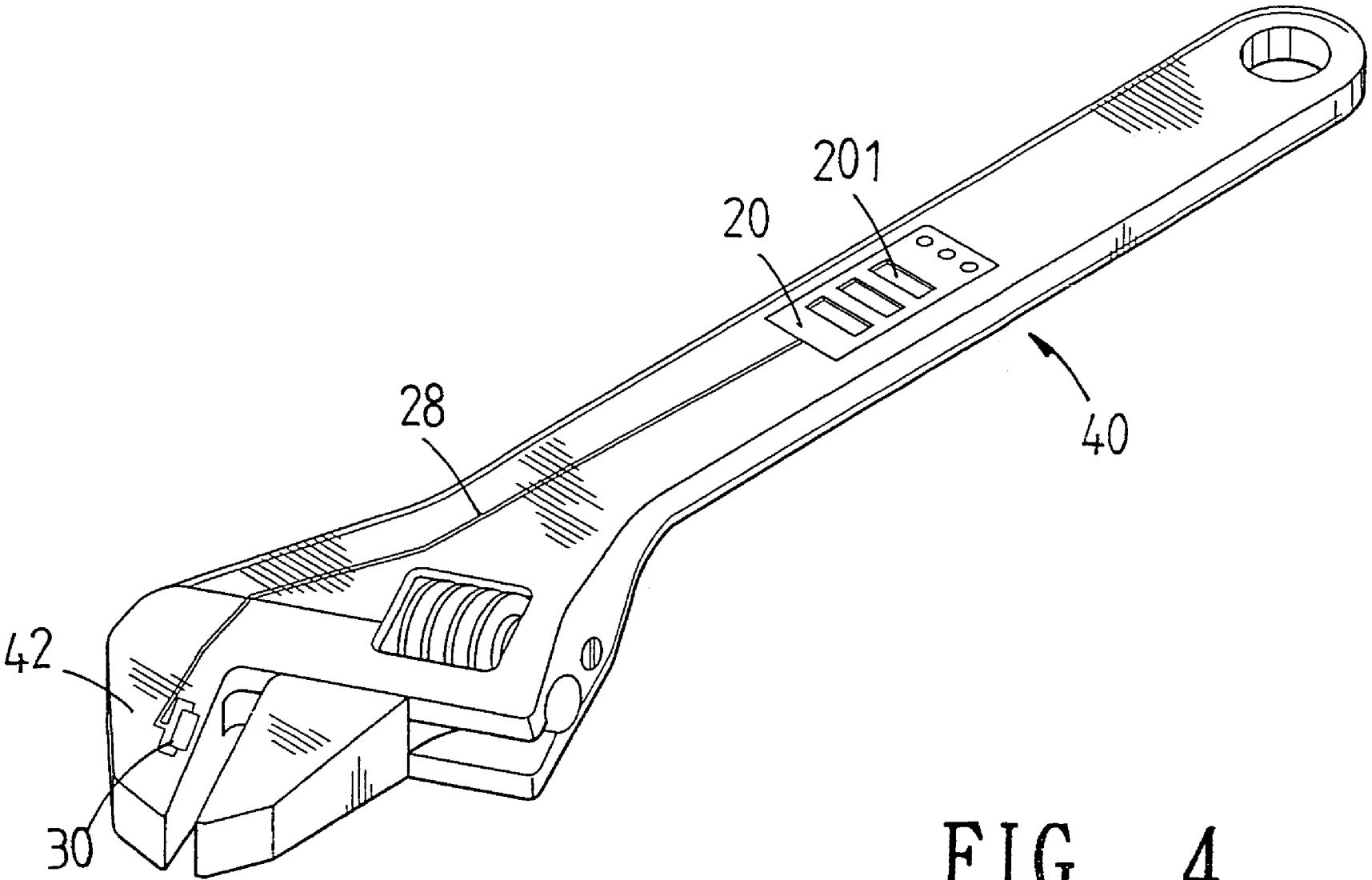
FIG. 4 is a schematic view about the second embodiment of the present invention.

With reference to FIG. 4, the second embodiment about the low-cost high precision twisting measuring device of the present invention is illustrated. This embodiment is similar to former one, and thus those identical to the former one will not described further. Only the differences of the two are described.

In this embodiment, the piezoelectric ceramic sensor 30 is applied to an adjustable spanner 40. The piezoelectric ceramic sensor 30 is located in a fixed jaw 42 of the adjustable spanner 40, which can still achieve the object of high precision of the sensing of twisting force.

Figure 5:
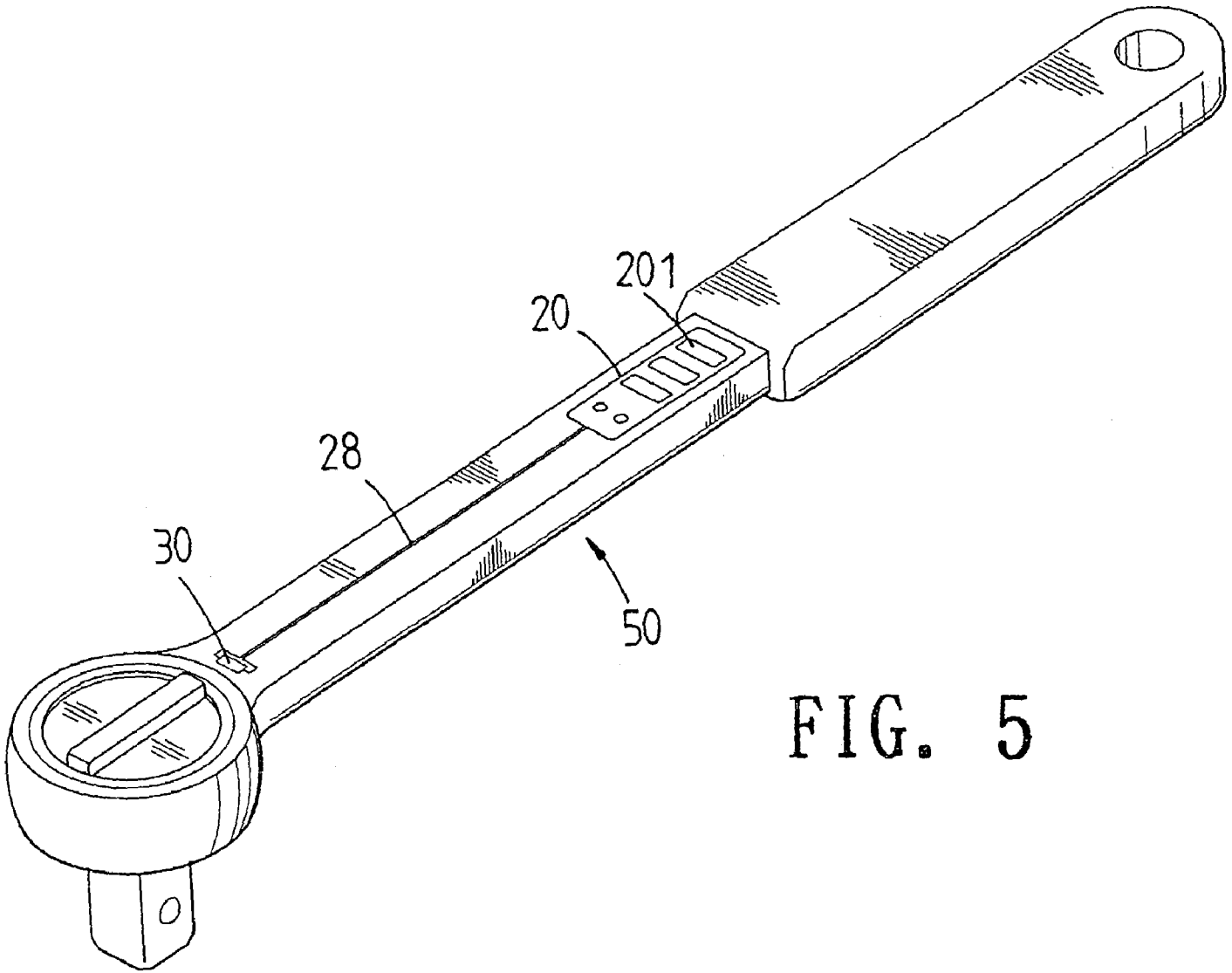
FIG. 5 is a schematic view about the third embodiment of the present invention.

Furthermore, referring to FIG. 5, the third embodiment of the present invention is illustrated. This embodiment is similar to former one, and thus those identical to the former one will not described further. Only the differences of the two are described.

In the third embodiment, the piezoelectric ceramic sensor 30 is applied to a sleeve form spanner 50, which can still achieve the object of high precision of the sensing of twisting force.

Figure 6:
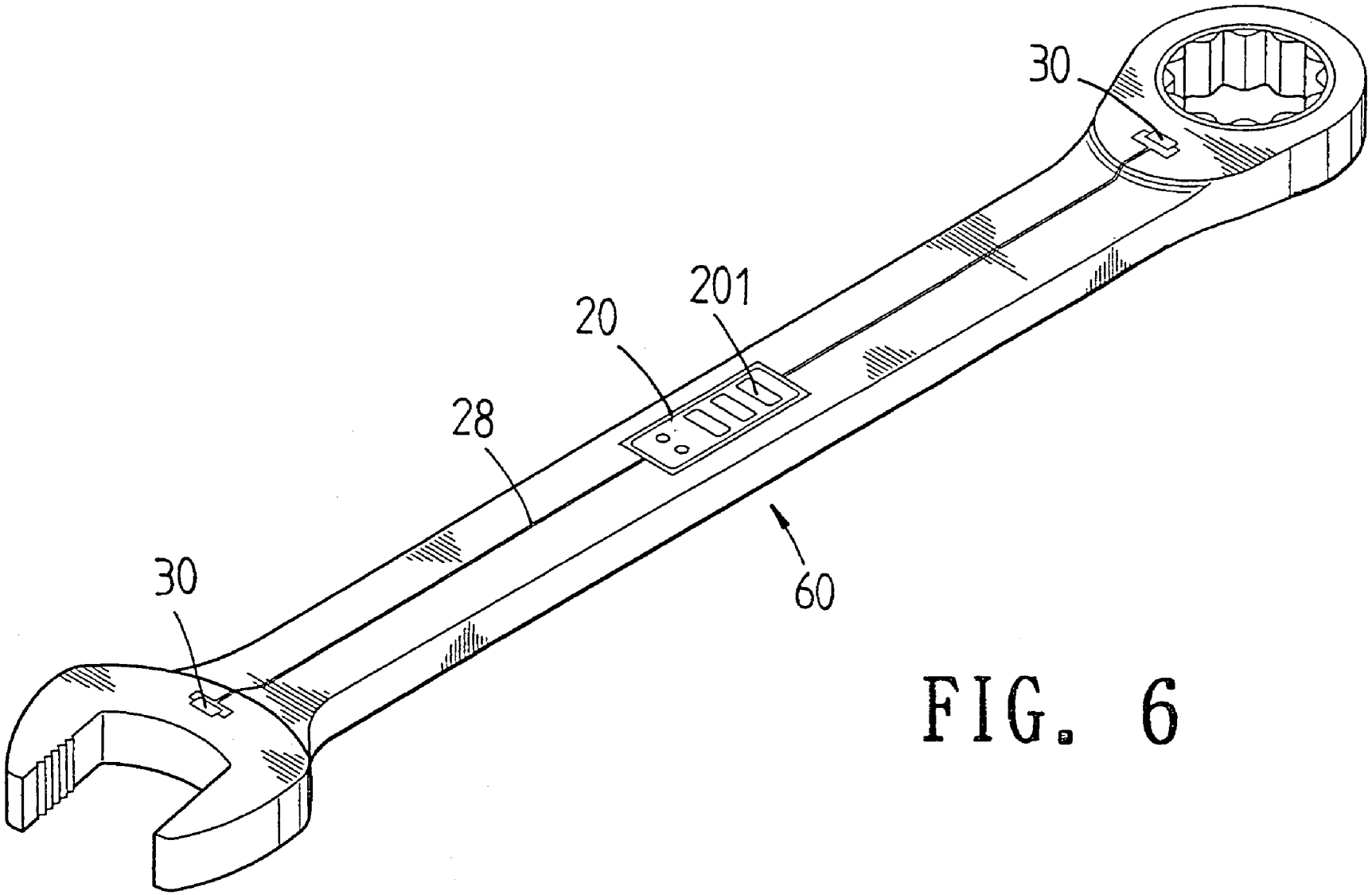
FIG. 6 is a schematic view about the fourth embodiment of the present invention.

Furthermore, referring to FIG. 6, the fourth embodiment of the present invention is illustrated. This embodiment is similar to former one, and thus those identical to the former one will not described further. Only the differences of the two are described. In the third embodiment, the piezoelectric ceramic sensor 30 is applied to a ratchet spanner 60, which can still achieve the object of high precision to the sensing of twisting force.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A low-cost high precision twisting measuring device comprising a tool body; the tool body comprising:

a handle having a display;

at least one end of the handle having a driving portion; and each connection between the handle and each driving portion having a piezoelectric ceramic sensor; the piezoelectric ceramic sensor being connected to the display through a conductor; the piezoelectric ceramic sensor serving to convert mechanical power from the operation of a spanner into electric power with a form of voltage signals; the voltage signal being transferred to the display though the conductor;

wherein one end of the handle has an open ended driving portion and another end of the handle has a ring driving portion.

2. A low-cost high precision twisting measuring device comprising a tool body; the tool body comprising:

a handle having a display;

at least one end of the handle having a driving portion; and each connection between the handle and each driving portion having a piezoelectric ceramic sensor; the piezoelectric ceramic sensor being connected to the display through a conductor; the piezoelectric ceramic sensor serving to convert mechanical power from the operation of a spanner into electric power with a form of voltage signals; the voltage signal being transferred to the display through the conductor;

wherein the tool body is a sleeve spanner which has a sleeve at one end of the spanner.

3. A low-cost high precision twisting measuring device comprising a tool body; the tool body comprising:

a handle having a display;

at least one end of the handle having a driving portion; and each connection between the handle and each driving portion having a piezoelectric ceramic sensor; the piezoelectric ceramic sensor being connected to the display through a conductor; the piezoelectric ceramic sensor serving to convert mechanical power from the operation of a spanner into electric power with a form of voltage signals; the voltage signal being transferred to the display through the conductor;

wherein the tool body is a ratchet spanner for driving a ratchet.

* * * * *